US005238345A

United States Patent [19]

D'Andrea

[11] Patent Number: 5,238,345

[45] Date of Patent: Aug. 24, 1993

[54] METHOD OF MAKING A PUBLICATION

[76] Inventor: Deborah B. D'Andrea, 110 Twin Oaks Rd., Akron, Ohio 44313

[21] Appl. No.: 922,526

[22] Filed: Jul. 31, 1992

[51] Int. Cl.[5] ..... B42C 19/00

[52] U.S. Cl. ..... 412/4; 281/15.1; 283/63.1; 283/67; 283/117

[58] Field of Search ..... 281/15.1; 283/63.1, 283/67, 117; 412/4, 6, 7, 8, 19, 43

[56] References Cited

U.S. PATENT DOCUMENTS

| | | | |
|---|---|---|---|
| 3,892,427 | 7/1975 | Kraynak et al. . | |
| 3,982,744 | 9/1976 | Kraynak et al. . | |
| 4,200,867 | 4/1980 | Hill . | |
| 4,616,327 | 10/1986 | Rosewarne et al. . | |
| 4,857,955 | 8/1989 | Crandall . | |
| 4,928,243 | 5/1990 | Hodges et al. . | |
| 4,974,171 | 11/1990 | Yeh et al. . | |
| 5,009,626 | 4/1991 | Katz . | |
| 5,018,085 | 5/1991 | Smith, Jr. . | |
| 5,031,935 | 7/1991 | D'Andrea . | |
| 5,036,472 | 7/1991 | Buckley et al. . | |
| 5,056,029 | 10/1991 | Cannon . | |
| 5,114,291 | 5/1992 | Hefty | 412/8 |

OTHER PUBLICATIONS

Two-page sales brochure from CAR-PEC Graphics entitled "Keeping Up with the Changes".

"Disney's Beauty and the Beast," Golden's Giant Sticker Fun.

*Primary Examiner*—Paul A. Bell

*Attorney, Agent, or Firm*—Beveridge, DeGrandi, Weilacher & Young

[57] ABSTRACT

A method making a publication for use by organizations within a particular association which includes placing generic graphic representations on a plurality of page sets. The generic graphic indicia is subsequently enhanced by superimposing added indicia to the generic graphic indicia so as to depict a particular one of the organizations. For example, color schemes and logos of one or more particular team organizations of a common association such as a sports league can be added to depict members of the one or more particular teams. This allows for the distribution of similar page sets to a plurality of locations for enhancement to suit the needs of purchasers identifying with a particular organization. The page sets can also be provided with generic, non-variable written text that is provided in each of the page sets. Variable written text pertaining to a particular one, two or more of the organizations can also be added (e.g., a team name). Also, the method of the invention includes providing personalizing characteristics to the enhanced graphic indicia such as personalized text or personal pictorial representations. The pictorial representations are positioned so as to appear through facial cut outs formed in the enhanced graphic indicia.

22 Claims, 6 Drawing Sheets

METHOD OF MAKING A PUBLICATION

FIELD OF THE INVENTION

This invention relates to a method of manufacturing publications for use by organizations within a common association. More particularly, this invention relates to a method wherein generic graphic indicia, common to each of the organizations, is placed on sheets of paper of a plurality of the publications and individual publications are subsequently enhanced by superimposing additional indicia to depict a particular one of the organizations. This invention further relates to personalizing the publication by providing additional identifying means concerning a subject which is significant to the viewer of the publication.

BACKGROUND ART

The use of computer printing to insert personalized data into a preprinted text of a book, such as a child's name, address, friend's names and data of a personal nature, is known. An example of a method for personalizing preprinted text is disclosed in U.S. Pat. Nos. 3,982,744 and 3,982,427 to Kraynak. U.S. Pat. No. 5,036,472 additionally discloses typing in information on a preprinted greeting card so as to personalize the card. Computer programs for generating and combining for reproduction on a single format having standardized text and graphics or personalized text and graphics are known, per se, as shown in the Rosewarne et al. U.S. Pat. No. 4,616,327. Also known are electronic printers operated by a computer software program which print certain portions of the text in a color different from the remainder of the text. See U.S. Pat. No. 4,857,955. Moreover, U.S. Pat. No. 4,974,171 to Yeh et al. discloses a memory system for enhancing the transference of data from a data source to a printer. The memory system provides memory designations for four different types of data relating to text, fill areas, images and line graphics so that the most efficient memory storage means can be used for each type of data.

U.S. Pat. No. 5,031,935 discloses a book for young readers which contains pages with apertures cut therein, such that the apertures are capable of superimposing images affixed to the front and rear covers. The pages contain illustrations and/or text on the front and rear surface.

BACKGROUND DISCUSSION

Various associations, such as professional sports associations or leagues (e.g., NBA, NFL, NHL, MLB, etc.), have gained a high degree of popularity and recognition among people of all ages. Also organizations within these associations, such as the teams within particular cities, typically have a large following of admiring fans. Persons following a particular team are often highly biased against opposing teams in the league and often closely identify with the team of their choice. To enable fans to show identification with a particular team, the leagues make available a large assortment of sales products containing indicia representing the individual teams. As each team has a specific logo and color scheme, the products representing the different teams are made separately which necessitates large manufacturing costs and time expenditures.

Also, there is typically one or more individuals on a team which are the favorite of fans who identify with the team. For children, the favorite players often represent role models which children aspire to be like, especially with respect to performance in a particular sport.

SUMMARY OF THE INVENTION

The present invention provides a method which achieves an efficient and less expensive way for organizations or teams within a common association or league to separately identify themselves in a publication. The method of the invention enables a single source to produce a "master" publication, with indicia generic to each organization, for subsequent distribution to publishers in the locale of particular organizations such that a plurality of the master publications can be enhanced to depict the organization most favored in that area. The present invention also provides a method in which fans can closely identify themselves with a team of their choice and even a particular member of a team of their choice. The present invention, through its use of team association and story line, provides a publication which is exciting to read, fun and educational. The story line can be personalized and written so as to build feelings of confidence and self esteem in a child by having the child achieve an important goal such as hitting a game winning home run or the winning basket at the buzzer.

In so doing, the present invention features a method for making publications (books or other tangible mediums of expression) for use by organizations within a common association. Each publication comprises a set of pages and the method includes placing graphic indicia on individual pages of each of the sets of pages. The graphic indicia is generic with respect to each of the organizations and pertains to the association. The method also includes enhancing pages within at least one of the page sets having generic graphic indicia by applying additional indicia to those pages so as to convert the generic graphic indicia to depictions which depict a particular one of the organizations in the association. The method further includes personalizing at least one of the publications by adding identifying means for identifying a subject significant to a reader of the publication and free from association with the association and the organization. Personalizing the at least one publication preferably includes positioning a pictorial representation (e.g., photograph) on a page of the publication such as the last page or the interior surface of a hard cover and forming cut-outs in intermediate pages and the front cover so that the face is visible throughout the publication.

The generic graphic indicia preferably depicts individuals in a sports league in a uniform that is generic with respect to all of the organizations in the league. The generic graphic indicia can also include background indicia that pertains to the sport of the particular sports league being represented.

Enhancing the pages also preferably includes modifying generic graphic indicia so as to depict an individual that is a member of one of the organizations. The pictorial representation can be positioned such that it is aligned with a facial cut-out in the graphic depiction of the individual such that the subject appears to be the individual that is a member of one of the organizations. For example, the generic graphic indicia can include a generic depiction of a sports player in uniform and the enhancing indicia can include the logo, color scheme, uniform striping and name or number of a particular player on the team or just the color scheme and number of either a particular player or just a fictional player on that particular team. The player depicted by enhanced generic graphic indicia has the cut-out in the facial area and the subject's face appears through the cut-out.

In a preferred embodiment, cut-outs are provided in a plurality of pages such that the face portion of the subject is viewable through a plurality of pages. Text can be provided which corresponds with the enhanced depictions appearing on the pages. Also, to even further personalize the publication, some of the text which is placed on the pages can be with specific reference to the subject; for instance, "the coach looked to [subject's name] to replace the injured player".

Thus, in one embodiment of the invention, the step of placing graphic indicia on individual pages includes providing characterizations of a team member or a plurality of team members with generic representations of each member's team uniform, and wherein enhancing at least some of the pages includes providing color to the team uniforms which is characteristic of a particular team within the sport association. Also, the step of personalizing the publication may also include providing a plurality of cut-outs in respective facial areas of the characterization of a plurality of team members and providing facial pictorial representations of individuals on a sports team (e.g. a little league team) that is free from association with the corresponding sports league and which representations are visible through the cut-outs.

The method of the invention also includes enhancing pages in a different one of the page sets with added indicia that converts the generic graphic indicia in the different page set so as to depict a different one of the organizations within the same league. Accordingly, a plurality of the same sets of pages or "master publications" with generic graphic indicia can be shipped to a plurality of different locations wherein each location provides enhancement graphics corresponding with the favored organization at that location.

The present invention also makes it possible to enhance pages so as to illustrate two different organizations on the same page or within the same page set. For example, two different rival sports teams can be shown in competition. The individual teams are shown separately based on their associated color scheme, uniform striping, logos, etc. The generic graphic indicia would include, in this situation, a generic depiction of two teams in competition and thus the enhancing step can be conducted at any location to feature the local favorite team in competition with the main rival of the favorite team.

The generic graphic indicia can be in the form of action scenes wherein the silhouette of a plurality of individuals are shown. The action scenes can be extended for two adjacent pages within the page sets.

The step of enhancing can also feature providing sufficient detail (e.g., name, team number, etc.) to a generic representation of an individual to designate a particular individual which is a member of the organization and is familiar to the viewer.

Fixed text (i.e., text that is non-variable from page set to page set) is preferably provided to the pages at the time of applying the generic graphic indicia but could be applied at a later stage (e.g., at the same time the generic graphic indicia is being enhanced). Variable text, such as text which changes from set to set and which can include personal information about either an individual associated with the team (e.g., stats for a particular sports player) or, more preferably, personalized data which is significant to a subject not associated with the association (e.g., the name of the purchaser's child), can be added to the page set.

When the variable text involves a particular member of the team, it is possible in the present invention to place a pictorial representation of that player in a cut out which matches with the facial area of an enhanced generic representation of a team member. More preferably, however, a facial representation of someone significant to the viewer (e.g., the viewer's own face) and not associated with any of the organizations is provided.

The above described method of the present invention also provides for a unique publication which comprises a plurality of sheets, with at least some of the sheets including graphic indicia generically depicting individuals which are members of an association comprised of a plurality of organizations. At least some of the sheets further comprise enhancing indicia which includes coloring and logos for depicting the individuals as members of a particular one of the organizations in the association. The individuals include facial areas and a plurality of the sheets have a common individual depicted in each. The facial area of the common individual has an aperture formed therein which is aligned on at least some of the sheets in which the common individual is depicted. There is also provided a pictorial facial representation of a subject which is free from association with the association, the pictorial facial representation is positioned on the publication so as to be visible through the cut-out formed in each of the depictions of the common individual. Also provided as part of the publication is text which relates to the individual depictions and personalized text which is in personal reference to the subject.

BRIEF DESCRIPTION OF THE PREFERRED EMBODIMENTS

The present invention will be more fully understood from the detailed description given herein below and the accompanying drawings which are given by way of illustration only, and thus are not limitative of the present invention and wherein:

FIG. 1 illustrates, in perspective, one embodiment of a publication formed in accordance with the method of the present invention;

FIG. 2 provides an elevational view of the cover of another embodiment formed in accordance with the method of the present invention;

DETAILED DESCRIPTION OF THE PREFERRED EMBODIMENTS

Figure 1:
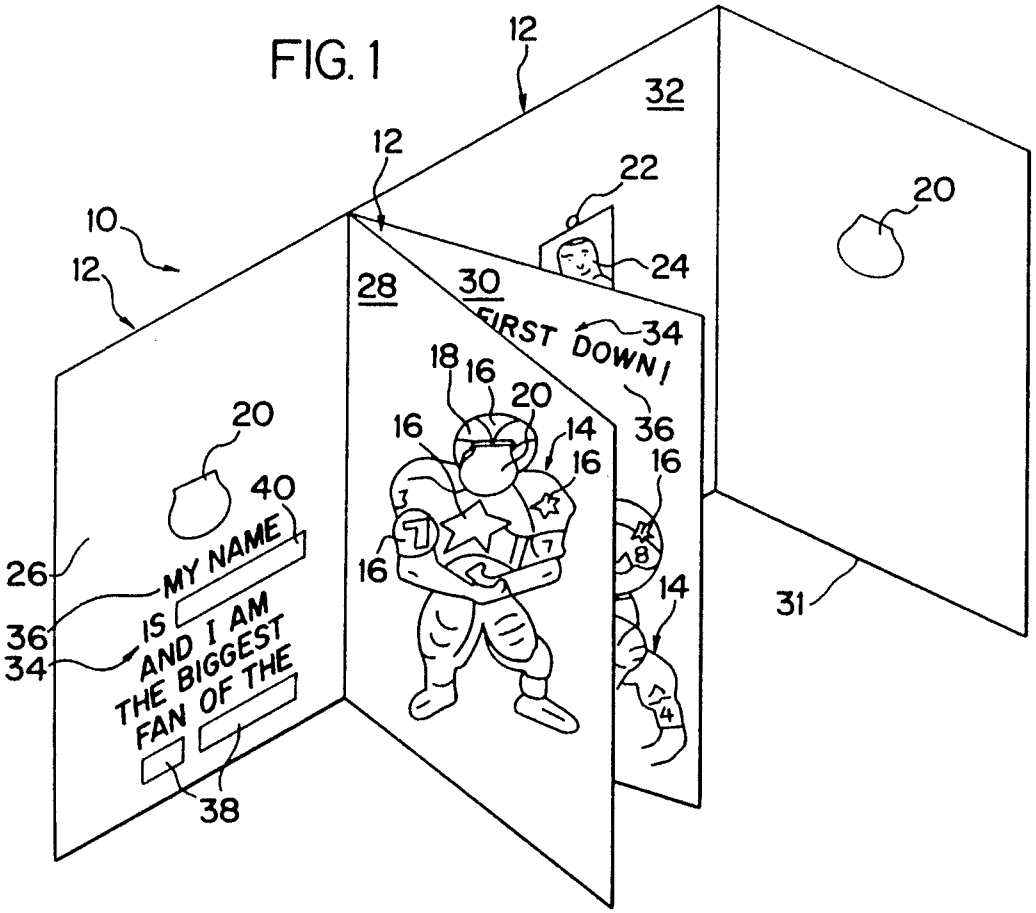

FIG. 1 of the present invention illustrates, in perspective, one embodiment of a completed publication 10 formed in accordance with the method of the present invention. Publication 10 is shown to comprise a page set 12 which includes front cover page 26, intermediate pages 28 and 30, back cover page 32 and gate fold 31. The front and back cover pages can be formed of the same material as the intermediate pages or, more preferably, of a more durable material such as a wipeable plastic or of a thicker paper material (hard cover material). The cover pages and intermediate pages can be joined in any one of the methods commonly known in the art (e.g., staples or adhesive along a back binder) or placed in loose leaf fashion within a continuous sheet folded to represent the back, front cover and gate fold. Also, although only a few intermediate pages have been shown, any desired number of intermediate pages can be used.

Intermediate pages 28 and 30, gate fold 31, and front cover 26 are each formed with at least one cut-out 20 which is positioned essentially at the same location on each of the pages so as to be in alignment.

FIG. 1 also illustrates generic graphic indicia 14 outlining an individual wearing a football uniform. The generic graphic indicia 14 is shown in FIG. 1 to have been subjected to an enhancement method step which includes the addition of added indicia 16 which can take any form which will depict and distinguish one organization in an association from the remaining organizations in the association. For example, indicia that would be capable of converting a generic depiction of an individual in a professional sports league to a depiction of an individual belonging to a particular team in that league would be suitable. The added indicia 16 can thus take the form of a particular color scheme, team logos, striping, numbers, etc. FIG. 1 illustrates added indicia 16 in the form of a team's logo on the helmet 18 and jersey of a football player as well as numbers on the jersey of the football player. The other intermediate page 30 also features enhanced generic representations of players in action (partially shown).

FIG. 1 further illustrates picture storage means 22 provided on the interior face of back cover page 32. Storage means 22 can take the form of a device which depicts the proper position of pictorial representations such as photograph 24 and which helps maintain the photograph in position. The proper positioning of the photograph results in the facial component of the photograph being aligned with the cut-outs 20 formed in the intermediate pages, front cover page and gate fold 31. Storage means 22 can also include adhesive tabs (not shown) to facilitate placement of the pictorial representation. Alternatively or in addition, the storage means 22 can include a clear plastic pocket or cover.

FIG. 1 also illustrates the positioning of cut-out 20 in the facial area of the enhanced generic graphic representation of a football player. Cut-out 20 is actually configured to correspond with the open facial area of helmet 18.

On the interior of cover page 26 and on the front face of page 30 there is provided text 34 which preferably forms part of a storyline extending throughout the publication 10. Text 34 is shown in FIG. 1 to comprise non-variable text portion 36 (i.e., text which is generic to each organization in the association and text which does not include personalized data concerning the intended viewer of the publication). Text 34 also includes variable text portion 38 which relates specifically to an organization within the association and will vary in accordance with what team is or teams are represented in the enhancement step. Reference number 38 for instance, could be the team name "LA STARTS" (fictitious) to name the particular organization represented by the team logo and color scheme provided by added indicia 16. Text portion 40 (shown schematically) represents personalized text which features personal characteristics of the intended viewer (e.g. "JOHN") of the publication.

Figure 2:
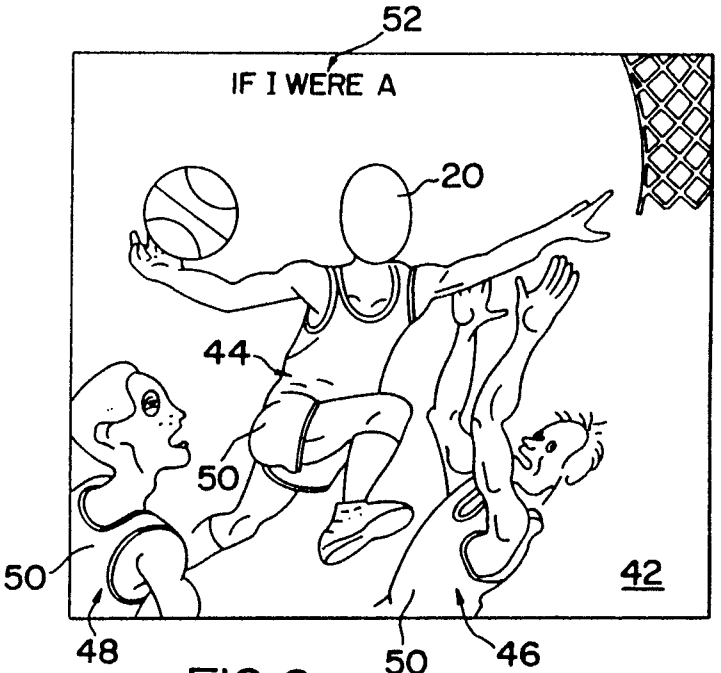

FIG. 2 illustrates cover page 42 of an alternate embodiment of the invention which features generic graphic indicia showing generic depictions of basketball players prior to the step of enhancement with added indicia to depict one or more particular basketball teams within a basketball league or association. As shown in FIG. 2, players 44, 46 and 48 each are shown wearing a generic representation of a basketball uniform 50. Cover page 42 also includes cut-out 20 formed in the facial area of player 44. As in the previous embodiment, cut-out 20 in cover page 42 would be aligned with a pictorial representation such that the facial area of the pictorial representation at the back of the publication (for which page 42 forms the cover) would be viewable when the cover page is closed. Cover page 42 also includes generic or non-variable text portion 52 which is to be completed or supplemented in an enhancement step described in greater detail below.

Figure 3B:
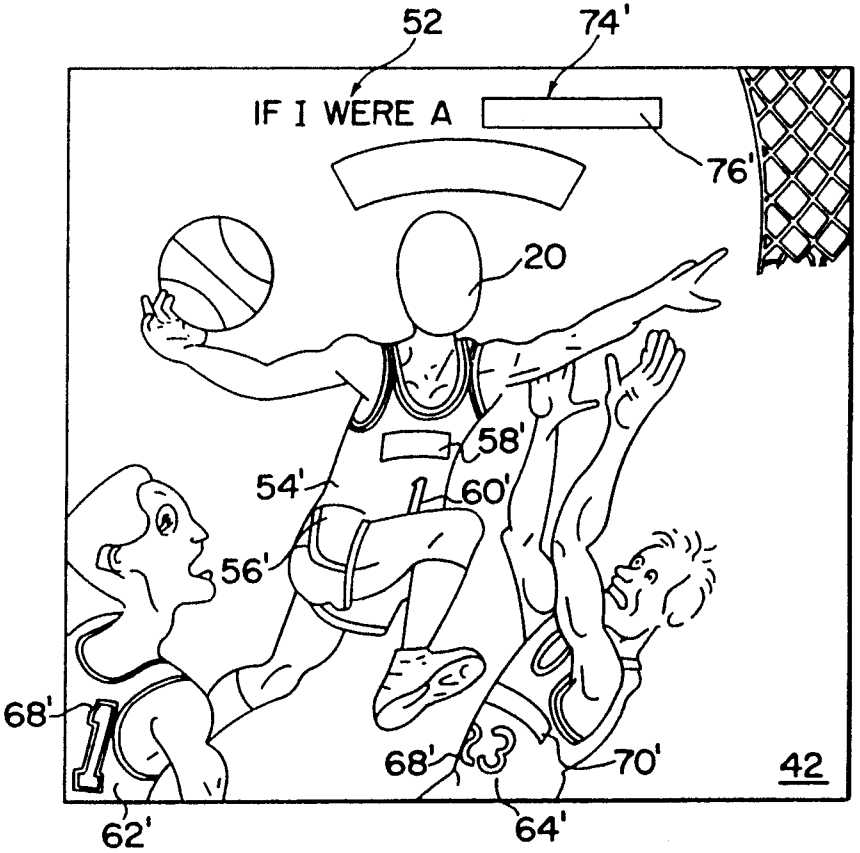
FIG. 3B illustrates a second embodiment following enhancement of the generic graphic indicia contained in FIG. 2.
Figure 3A:
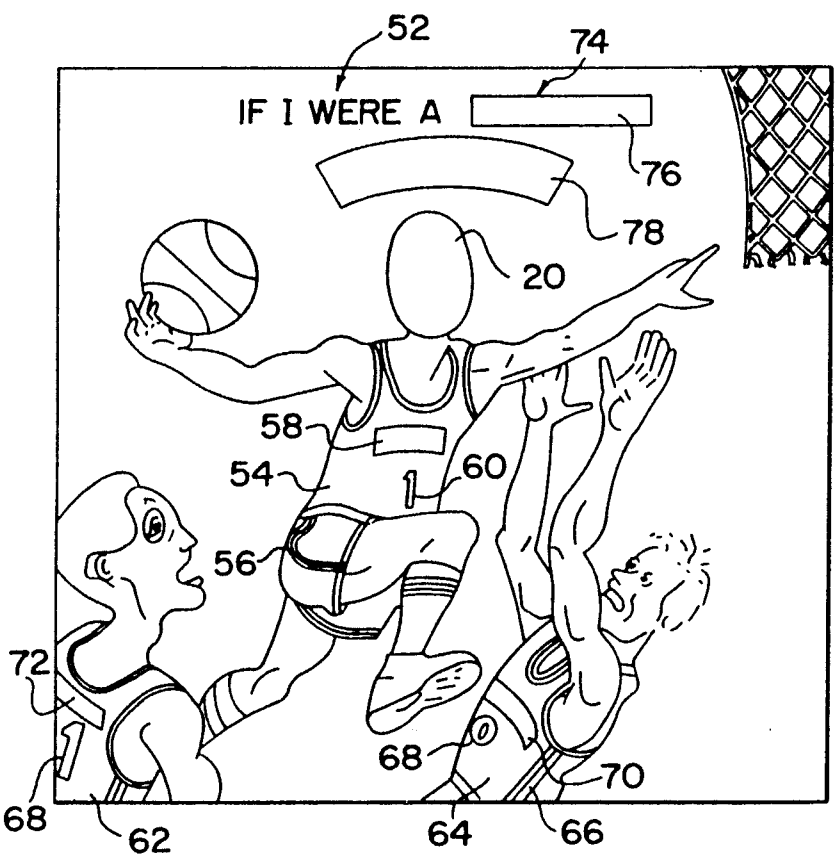
FIG. 3A illustrates one embodiment following enhancement of the generic graphic indicia contained in FIG. 2.

FIG. 3A of the present invention shows the generic depiction of FIG. 2 following the method step of adding indicia which converts a generic depiction of an individual to at least one individual associated with a particular team in the league. Thus, in FIG. 3A, the generic uniform 50 of player 44 has been enhanced so as to represent a uniform 54 of a particular team. In the embodiment shown in FIG. 3A, uniform 54 has been enhanced so as to include the color scheme (e.g. green background/white lettering), uniform striping 56 and a team name represented schematically at 58 (e.g. the "BOSTON VIKINGS" basketball team).

FIG. 3A also illustrates that the non-variable text portion 52 which, in the particular embodiment shown in FIG. 2, read "IF I WERE A" has been enhanced with variable text 74 to include the city designation 76 ("BOSTON") and schematically represented name 78 (e.g. "VIKINGS") of a preferred team of the intended viewer of the publication. In addition to the team logo, the generic uniform 50 of FIG. 2 has also been enhanced by the addition of a number "1" (referenced by reference number 60). The addition of a number provides a way for depicting a particular player within the organization that is the favorite of the intended viewer.

FIG. 3A also illustrates the addition of added indicia to convert the generic depiction of uniformed players 46 and 48 into members of a different team in the league which is preferably a main rival to the preferred team. FIG. 3A shows the conversion of generic players 46 and 48 in FIG. 2 to member players 62,64 of a particular opposition team through the placement of added indicia such as that represented schematically as 70 which could be, for example, the name of the rival team "Stars" team uniform markings 66 and the team's color scheme (not shown). The addition of enhancement indicia such as a players, name shown schematically of 72 not only identifies specific opposition team players but also helps in defining the team itself. The opposition team members are also shown in FIG. 3A to have jersey numbering 68. Although not shown for this particular embodiment similar enhancement steps would be taken to convert other generic representations appearing on the other pages in the publication for which the cover page in FIG. 3A forms the cover. A story line could thus be provided with respect to the basketball embodiment shown in FIG. 3A in a manner similar to that which was previously discussed for the football embodiment of FIG. 1. In addition to the generic graphic representations described above, the present invention also contemplates providing background indicia such as the audience depicted in FIG. 8 and/or coloring to highlight areas of each page which are not affected by the enhancement process. The background indicia could thus form part of the "master publication" and be provided at the time of placing the generic graphic representations on the page sets. For example, the basketball shown in FIGS. 2 and 3A can be colored orange in a step proceeding the above-described enhancement step wherein, preferably, a particular team or teams' color scheme is added to the generic representation of a player.

FIG. 3B shows another embodiment following the addition of enhancement indicia to the generic uniform depictions in FIG. 2. In FIG. 3B the features which are similar to those in FIG. 3A have been designated with the same number only dashed. A comparison of FIGS. 3A and 3B reveals the depiction of two different sets of rival teams in competition with both stemming from the same graphic indicia. In FIG. 3A the rival teams where described as being the "Boston Vikings" and the "Los Angeles Stars" while FIG. 3B represents the Cleveland "Chargers" (Chargers being schematically represented at 53') in competition with the Chicago "Bison" ("Bison" being schematically represents by 70') with all four teams being organizations within a national sports association. Thus, a Boston area publisher can readily publish a publication with the Vikings while a Cleveland publisher can readily publish a publication with the Chargers with both publications having the same storyline, background graphics and generic uniform and player depictions.

Figure 4:
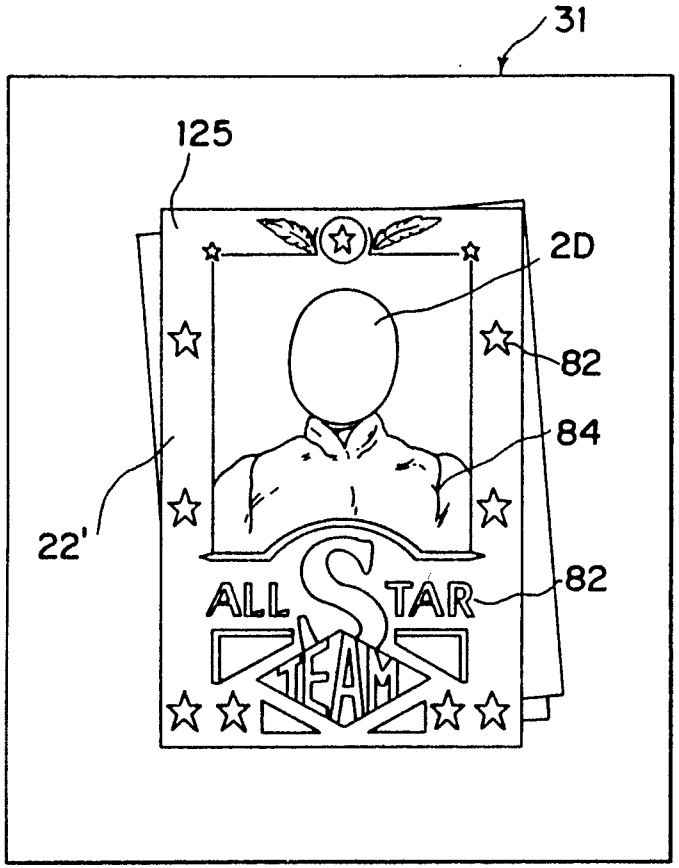
FIG. 4 illustrates the sports card which is positioned over the pictorial representation.

FIG. 4 depicts in greater detail a sports card 125 which would appear on the back of gate fold cover 31 of a publication formed in accordance with the present invention (sports cards would be on the face of gate fold cover 31 which is not shown in FIG. 1. FIG. 4 shows cut out 20 formed in generic indicia 82 (text and graphics) in sports card 125 which, in this embodiment, is for a baseball person 84. Cut-out 20 is positioned such that the placement of the facial area of a pictorial representation of someone significant to the intended viewer (e.g., a picture of the intended viewer) on to the front surface of the back cover results in the subject being viewable through the sports card.

Figure 5:
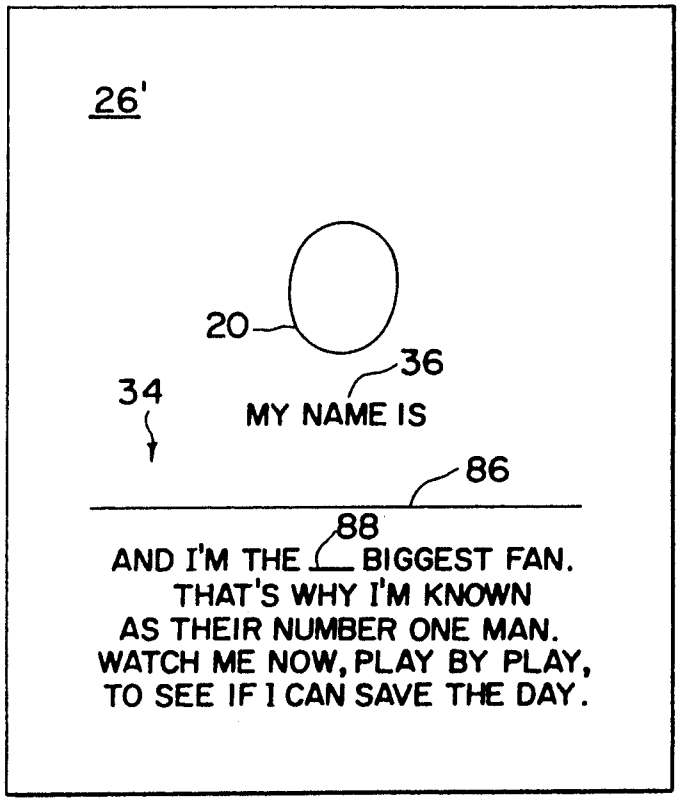
FIG. 5 illustrates one of the first pages of text with generic, non-variable text placed thereon.

FIG. 5 shows the inside surface of a front cover page 26' similar to cover page 26 shown in FIG. 1 prior to enhancement. As shown in FIG. 5, cut-out 20 is formed in the cover page 26' and text 34 is placed on the interior surface of the cover page. Prior to the step of enhancement, there exists non-variable text 36 as well as a line 86 for insertion of personal characterization data or identifying means such as the intended viewers name. Also, FIG. 5 shows that prior to enhancement a blank space or line 88 is provided to provide room for the addition of the name of a preferred team of the intended viewer. The personal data and team indication can be inputted manually by the viewer or in an automated process prior to receipt by the intended viewer.

Figure 7:
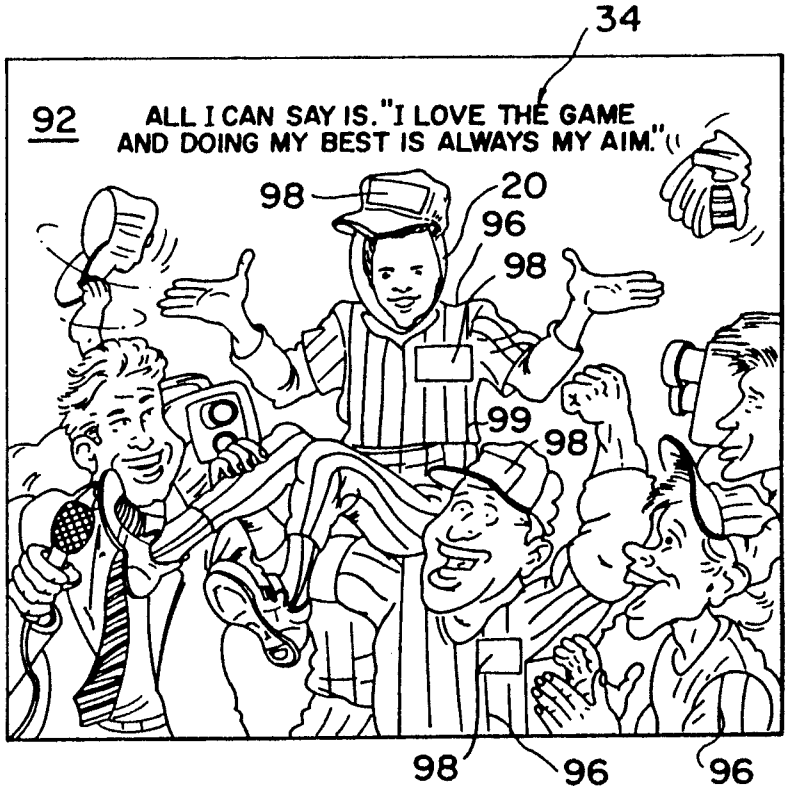
FIG. 7 illustrates the front face of a subsequent page in the same publication containing the page shown in FIG. 6.
Figure 6:
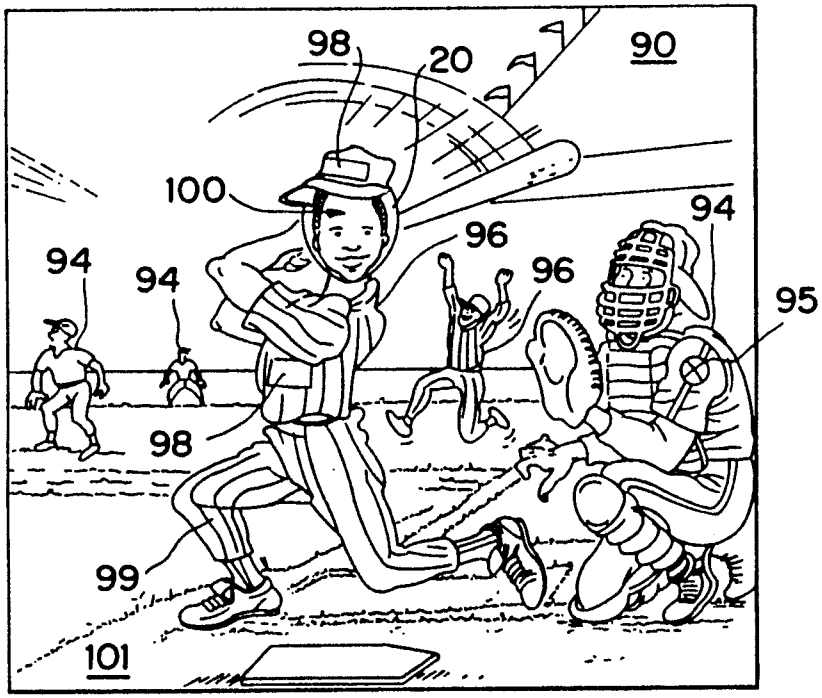
FIG. 6 illustrates a front face of one page of the publication with a pictorial representation visible through a cut out formed therein.

FIGS. 6 and 7 illustrate sequential front faces of intermediate pages 90 and 92 to be placed in a page set like that described for FIG. 1. FIGS. 6 and 7 also illustrate how the facial portion 100 of a picture placed on a back page support (like that illustrated in FIG. 4) appears in alignment through numerous cutouts. Also FIGS. 6 and 7 show how the cut-out 20 is formed in the facial area with respect to a particular enhanced graphic representation of a baseball player on the preferred team. Players 94 which are shown as being on an opposition team through the addition of enhancement indicia such as uniform indicia 95 are depicted in active competition with members 96 on the preferred team which is depicted with added indicia such as a team logo 98 (e.g. "NJ") and pin striping 99. FIG. 7 also illustrates text 34 being entirely non-variable for that particular page. Although not shown, background 101 can be colored prior to enhancement (e.g. grass green, base running paths brown, etc.) can be colored as such coloring would be the same for each team in the league.

Figure 8:
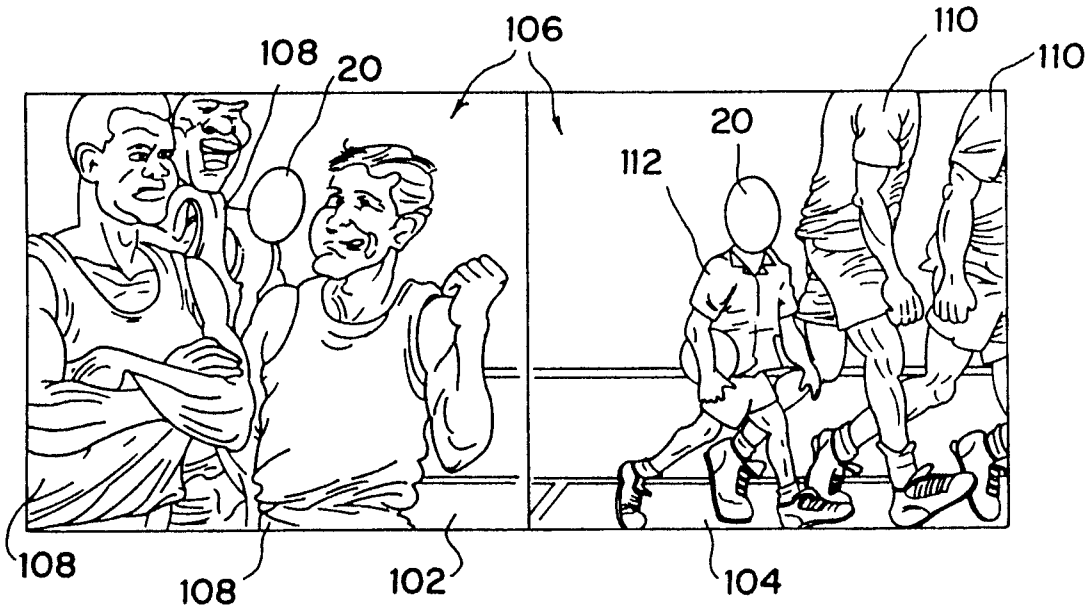
FIG. 8A shows a rear face of a first page of a publication formed in accordance with the present invention and a front face of a page immediately following.

FIG. 8 of the present invention illustrates a rear face 102 and a front face 104 of the next sequential intermediate page which are to form part of a page set for a publication. FIG. 8 shows generic graphic representations of basketball players with the graphic representations being essentially uninterrupted across rear face 102 and front face 104. FIG. 8 additionally shows a grouping of players 108 that will eventually be enhanced to depict the opposition players. FIG. 8 also shows generic representations which will eventually b enhanced to show members of the team preferred by the intended viewer. Unlike the previous embodiments, however, rather than depicting a generic representation of an individual with facial cut-out as having a body configuration of one of the team players, FIG. 8 shows a graphic representation of player 112 with facial area cut-out and of a size conforming closer to the intended viewer than to a typical team player. This enhances the ability of the viewer to feel associated with the preferred team. Cut-out 20 on page 102 is not positioned in the facial area of a player as it would be on the front face of page 102 (not shown). By extending the generic graphic indicia over the two pages, the story line is less interrupted by the fact that the cut-out 20 on page 102 is not in the facial area of a player.

Figure 9:
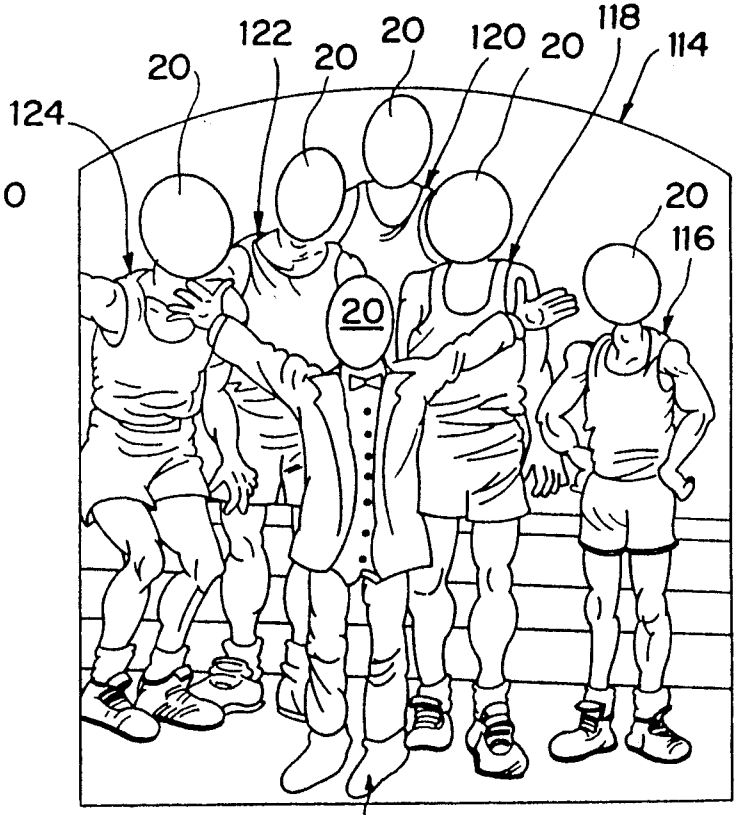
FIG. 9 shows generic graphic indicia of a sports team with coach and each player having a facial cut-out.

FIG. 9 shows another embodiment of an intermediate page with generic graphic indicia 114 showing basketball team players 116, 118, 120, 122 and 124 together as well as a generic graphic depiction 126 of a coach. The generic graphic depictions 116, 118, 120, 122, 124 and 126 each include a facial cut-out 20. In this alternate embodiment of the invention, a plurality of pictorial representations (such as those of a lower grade school team) can be inserted so as to be visible at least in the one generic representation.

The method of the present invention includes assembling a plurality of page sets with at least some of the pages in each page set having generic graphic indicia placed thereon. The generic graphic indicia depicts in generic fashion individuals of a particular association and, preferably also includes some background or environment depictions which corresponds with the activity of the association. Each page set is assembled so as to have the same generic graphic indicia.

The initial placement of the generic graphic indicia on the pages of the publication can be achieved in any of the known methods known in the art. For example, the generic graphic indicia (which can include generic background indicia) can be computed in four color art and scanned into a computer color separator to create a "master" publication data base which can be immediately placed in hard copy or transferred by data storage means to the location where enhancement is to take place.

The placement of the generic graphic indicia on a plurality of the page sets is done such that areas are left for the insertion of the added enhancement indicia. For example, in the embodiment shown in FIG. 2 the uniforms of the players are left blank for the insertion of the teams color scheme, striping, logo etc. as represented by FIGS. 3A, 3B.

The non-variable text is preferably applied prior to the enhancement step (e.g. during, immediately before or immediately after the placing of the generic graphic indicia). The insertion of the text can be achieved through the use of a computer, printer and appropriate software or in any of the other known methods for applying text to page sheets.

The master publication is then further enhanced in an enhancement step wherein the blank areas remaining in the generic representations are filled in to convert the generic graphic representation to a representation readily identifiable with a particular organization (or team) in the association (or league).

The enhancement step can be carried out through the use of any sophisticated printer using existing software. Preferably the enhancement step involves placing an overlay that indicates the proper placement of the added indicia. Color codes can be provided in appropriate areas within the generic graphic indicia during a computer scanning process wherein the data for a particular master publication is stored in the memory of a computer. The color codes would trigger a printer in communication with a computer storing the information obtained by scanning to apply the appropriate color within the generic graphic indicia to achieve the conversion of the generic representation to one readily associated with a particular one of the organizations in the association of organizations.

The method of the present invention also features the formation and use of a plurality of the aforementioned overlays for application over various master publications. The overlays facilitate the conversion of a generic graphic representation to one depicting a particular organization. The overlays are preferably cataloged or stored by memory means in a library format for easy access. For instance, generic storyline and graphics for use with various associations or leagues (e.g., NBA, NFL, etc.) can first be categorized together, with each category being broken down into sets for each particular team within a league. An overlay or group of overlays corresponding with each team within a particular league would then be categorized in relation to the particular team or teams which are to appear following enhancement.

The present invention thus provides for the forwarding of the appropriate overlay together with the "master" publication material (e.g. tangible copies or stored data) to publishers or printers in the locale of a preferred team such that team specific final publications can be completed with relative ease and little expense. Further, the local publisher or printer can easily input the variable text concerning the local team (with known inputting techniques such as those relying on a computer, printer and software) and also provide the personal data based on information provided by an intended purchaser (using known software and the same equipment described above).

Figure 10A:
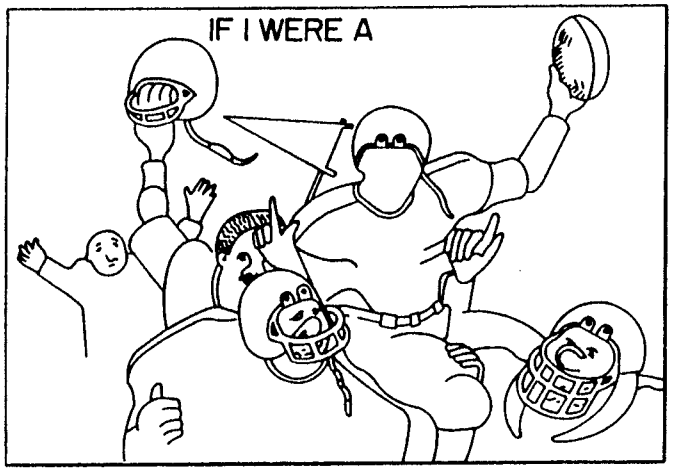
FIGS. 10A–10D illustrate steps involved in enhancing originally generic graphic indicia.
Figure 10B:
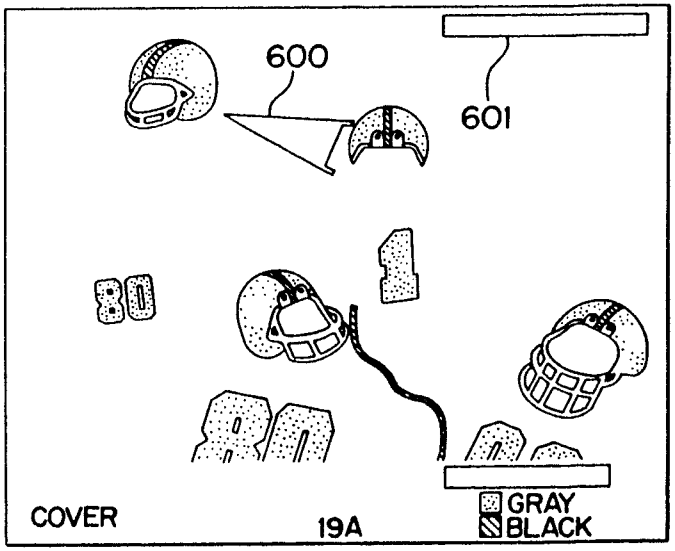

FIGS. 10A–10D illustrate the use of overlays in the enhancement of generic graphic indicia. FIG. 10A illustrates a sheet containing generic graphic indicia to appear on the cover of a publication. FIG. 10B illustrates a first overlay designated for use with the sheet and which is also designed for use in a publication involving the Los Angeles Raiders football team in competition with the San Francisco 49'ers. In the overlay of FIG. 10B the schematic box 600 designates the phrase "RAIDERS" and box 601 "LOS ANGELES RAIDERS".

Figure 10C:
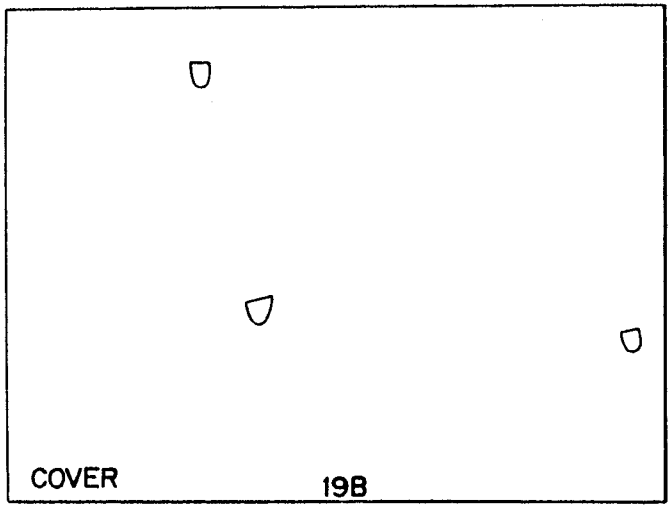
Figure 10D:
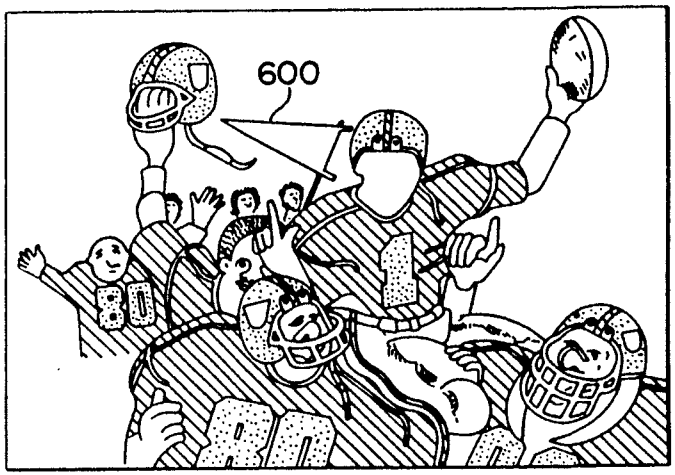

FIG. 10B shows one overlay sheet for the insertion of particular enhancement indicia which in this case involves the team name, team striping and jersey numbering. FIG. 10B also shows enhancement through use of certain colors (gray (or more specifically silver) and black). FIG. 10C features particular team logos, which are to be used in association (e.g. sequentially) with the overlay of 10B to provide the generic uniform depictions with the team logos. FIG. 10C also shows the use of operator instructors to facilitate the enhancement process. Numerals "19A" and "19B" provide reference to a particular set of overlay sheets, while "cover" determines" the appropriate page being enhanced and the alignment mark " " helps in aligning the overlays with respect to the generic graphic indicia sheet. In FIG. 10C box 602 represents the identifying phrase "Raiders v. 49ers" and box 604 represents various locations for the LA RAIDERS team logo (i.e. the familiar helmeted head with eye patch having crossing swords in the background). FIG. 10D illustrates a publication following completion of the enhancement step. FIG. 10D also illustrates the completion of the color scheme (gray and black) for the uniforms. The sequence of overlays and coloring would depend upon the software being utilized in the enhancement process. Color separations involved in the enhancement of the generic graphic indicia can be done on a "SCITEX" color separator available from Screen (Midwest) company located in Rolling Meadows, Ill.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention a defined in the appended claims.

What is claimed is:

1. A method of making publications which each include a set of pages associated with organizations within a common association, comprising:

placing graphic indicia, which is generic with respect to each of said organizations and which pertains to said association, on sheets;

subsequently enhancing said generic graphic indicia appearing on said sheets by applying additional indicia to said generic graphic indicia for converting the generic graphic indicia to depictions which are identifiable with a particular one of said organizations in said association;

providing printed pages comprising both the generic graphic indicia and the additional indicia added during enhancement and assembling the printed pages provided so as to form one of said set of pages; and personalizing at least said one of said set of pages by adding identifying means for identifying a subject significant to a reader of said publication and free from association with said association and said organizations in said association, and wherein enhancing the generic graphic indicia includes converting the graphic indicia such that a plurality of said printed pages each generally depict an individual that is a member of one of said organizations, and wherein personalizing said one of said set of pages includes positioning a pictorial representation of said subject on said publication and forming a facial cut-out in the depiction of said individual on each of said plurality of printed pages in which said individual appears such that a face portion of said pictorial representation is viewable through said facial cut-outs formed in said plurality of printed pages and the subject generally appears to be said individual that is a member of one of said organizations.

2. A method as recited in claim 1 further comprising providing text on at least some of said printed pages and said step of personalizing includes adding additional text which is personal to said subject.

3. A method as recited in claim 2 wherein the adding of additional text includes adding a space between portions of the additional text for providing room for the insertion of a name of the subject.

4. A method as recited in claim 1 wherein said association is a sport association and said organizations are teams of said sport association, and placing graphic indicia on sheets which is generic with respect to each of said organizations includes providing individual, generic characterizations of team members with generic representations of team uniforms.

5. A method as recited in claim 4 wherein enhancing said generic graphic indicia includes providing a color scheme to said team uniforms which is characteristic of a particular team in said sport association.

6. A method as recited in claim 5 wherein enhancing said generic graphic indicia further comprises adding number designations on said uniforms.

7. A method as recited in claim 5 wherein enhancing said generic graphic indicia includes providing at least one name of a particular individual on said team.

8. A method as recited in claim 4 wherein placing graphic indicia on individual pages includes providing characterizations of a plurality of team members with generic representations of team uniforms, and wherein enhancing said generic graphic indicia includes providing color to said team uniforms which is characteristic of a particular team in said sport association, and personalizing said publication includes providing a plurality of cut-outs in respective facial areas of the characterization of a plurality of team members and providing facial pictorial representation of individuals on a sports team that is free from association with said association and which are visible through said cut-outs.

9. A method as recited in claim 4 wherein enhancing said generic graphic indicia includes providing color to said team uniforms which is characteristic of two particular teams in said sport association which are in competition.

10. A method as recited in claim 1 wherein said step of enhancing said generic graphic indicia includes positioning an overlay with instruction means over the sheet containing the generic graphic indicia and converting a visual image of said generic graphic indicia and instruction means into computer processable data.

11. A method as recited in claim 1 further comprising enhancing pages in a different one of said page sets with additional indicia to convert the generic graphic indicia in said different one of said page sets to depict an image associated with a different one of said organizations.

12. A method of making publications which each include a set of pages and which are associated with teams within a common league, comprising:

placing colored, generic graphic indicia, which is generic with respect to each of said teams and which pertains to said league, on sheets;

scanning the colored, generic graphic indicia with a computer color separator assembly;

enhancing said colored, generic graphic indicia appearing on said sheets by applying additional indicia to said colored, generic graphic indicia for converting the colored, generic graphic indicia to depictions which are identifiable with a particular one of said teams in said league, said enhancing including converting the colored, generic graphic indicia so as to generally depict a uniformed individual member belonging to a particular one of said teams in said league by applying over said sheets containing said colored, generic graphic indicia a respective one of a plurality of overlays containing team identifying indicia, said enhancing further comprising utilizing said computer color separator assembly to convert a visual image of said enhanced generic graphic indicia to computer processable data;

printing pages based on the computer processable data for the enhanced generic graphic indicia, the printed pages including a plurality of pages containing a depiction of said uniformed individual member with team identifying indicia on the uniform as well as a depiction of a facial portion of the individual member;

assembling the printed pages into a page set with said page set containing the plurality of pages containing the depiction of said individual member with the facial portion;

forming an aligned cut-out through a plurality of pages in said page set such that the facial portion of said individual member is cut-out in the plurality of pages containing the depiction of said uniformed individual; and positioning a page of said page set behind said plurality of sheets containing said plurality of pages containing facial cut-outs so as to provide a supporting surface for a pictorial representation, the supporting surface being located such that the pictorial representation can be viewed through the facial cut-out formed in the plurality of pages depicting the individual member and so that an appearance is provided that the intended reader is a member of the particular team being identified.

13. A method as recited in claim 12 wherein said generic graphic indicia includes action depictions of a plurality of individuals in uniform and enhancing said generic graphic depictions include providing indicia which particularly designates an individual on said team.

14. A method as recited in claim 12 wherein enhancing said generic graphic indicia includes designating two different teams in said association in competition.

15. A method as recited in claim 12 wherein enhancing said generic graphic indicia includes placing a plurality of overlays over said generic graphic indicia with each overlay containing a portion of a total amount of the team identifying indicia.

16. A method as recited in claim 15 wherein enhancing the generic graphic indicia includes placing a first overlay over said generic graphic indicia with the portion of the team identifying means including uniform coloring and uniform numbering.

17. A method as recited in claim 16 wherein enhancing the generic graphic indicia includes placing a second overlay over said generic graphic indicia with the portion of the team identifying means including a team logo.

18. A method as recited in claim 12 further comprising fastening a pictorial representation of an intended viewer of the publication on the supporting surface of said page such that a facial area of the pictorial portion is viewable through the plurality of aligned cut-outs formed in the facial portion of the uniformed individual.

19. A method as recited in claim 12 further comprising providing said publication with textual matter which is generic with respect to each of said teams.

20. A method as recited in claim 19 further comprising providing said publication with textual matter which identifies a particular team among the teams in said league.

21. A method as recited in claim 20 further comprising providing an underlined area in said textual matter for providing room for insertion of a name of an intended viewer.

22. A method as recited in claim 21 further comprising manually inserting a name of the intended viewer at the underlined area.

* * * * *